US008991350B2

(12) United States Patent
Yang

(10) Patent No.: US 8,991,350 B2
(45) Date of Patent: Mar. 31, 2015

(54) RESET TYPE ROCKER BRAKING METHOD AND DEVICE

(75) Inventor: Zhou Yang, Oak Ridge, NC (US)

(73) Assignee: Shanghai Universoon Auto Parts Co., Ltd., Shanghai (CN)

( * ) Notice: Subject to any disclaimer, the term of this patent is extended or adjusted under 35 U.S.C. 154(b) by 0 days.

(21) Appl. No.: 14/117,843

(22) PCT Filed: Dec. 26, 2011

(86) PCT No.: PCT/CN2011/002187

§ 371 (c)(1),
(2), (4) Date: Feb. 13, 2014

(87) PCT Pub. No.: WO2012/155315

PCT Pub. Date: Nov. 22, 2012

(65) Prior Publication Data

US 2014/0182536 A1 Jul. 3, 2014

(30) Foreign Application Priority Data

May 18, 2011 (CN) ..... 2011 1 0129369

(51) Int. Cl.

| | |
|---|---|
| ***F01L 1/18*** | (2006.01) |
| ***F01L 1/20*** | (2006.01) |
| ***F01L 1/26*** | (2006.01) |
| ***F01L 13/06*** | (2006.01) |
| ***F01L 1/08*** | (2006.01) |
| *F01L 1/14* | (2006.01) |

(52) U.S. Cl.

CPC . *F01L 1/18* (2013.01); *F01L 1/181* (2013.01); *F01L 1/20* (2013.01); *F01L 1/267* (2013.01); *F01L 13/06* (2013.01); *F01L 1/08* (2013.01); *F01L 1/146* (2013.01)

USPC ..... 123/90.39; 123/90.16

(58) Field of Classification Search

USPC ..... 123/90.16, 90.39

See application file for complete search history.

(56) References Cited

U.S. PATENT DOCUMENTS

| | | | |
|---|---|---|---|
| 3,220,392 | A | 11/1965 | Cummins |
| 3,786,792 | A | 1/1974 | Pelizzoni et al. |
| 3,809,033 | A | 5/1974 | Cartlege |
| 5,564,385 | A | 10/1996 | Hakansson |
| 6,234,143 | B1 | 5/2001 | Bartel et al. |
| 6,253,730 | B1 | 7/2001 | Gustafson |

(Continued)

FOREIGN PATENT DOCUMENTS

| | | | |
|---|---|---|---|
| CN | 101769186 | A | 7/2010 |
| CN | 202090977 | U | 12/2011 |

(Continued)

*Primary Examiner* — Zelalem Eshete

(74) *Attorney, Agent, or Firm* — Wilmer Cutler Pickering Hale and Dorr LLP

(57) ABSTRACT

A reset rocker arm braking method and device are provided. A braking piston hole and an oil drain piston hole which are communicated with a braking oil supply passage are arranged inside a rocker arm, and an oil drain passage is arranged between the braking piston hole and the oil drain piston hole. When the rocker arm is driven by a braking cam lobe of a cam, an exhaust valve is opened to realize braking by a braking piston inside the braking piston hole. When the rocker arm is driven by an exhaust cam lobe of the cam, the rocker arm drives an oil drain piston in the oil drain piston hole to open the oil drain passage to discharge oil, and the lift profile of the exhaust valve is reset and reduced to a conventional exhaust valve lift profile without an engine braking.

13 Claims, 7 Drawing Sheets

(56) References Cited

U.S. PATENT DOCUMENTS

| | | | | |
|---|---|---|---|---|
| 6,334,429 | B1 | 1/2002 | Little, Jr. | |
| 6,439,195 | B1 | 8/2002 | Warner | |
| 6,691,674 | B2 * | 2/2004 | McCarthy et al. | 123/321 |

FOREIGN PATENT DOCUMENTS

| | | | |
|---|---|---|---|
| EP | 1022444 | B1 | 4/2003 |
| WO | 2012155315 | A1 | 11/2012 |

* cited by examiner

RESET TYPE ROCKER BRAKING METHOD AND DEVICE

TECHNICAL FIELD

The present application relates to the mechanical field, specifically to the valve actuation field for vehicle engines, particularly to method and device for a reset rocker arm braking.

BACKGROUND

In an engine braking method, an exhaust valve is opened at a later stage of a compression stroke of an engine piston and closed at an earlier stage of an expansion stroke (generally before the normal opening of the exhaust valve). An example of an engine brake was disclosed by Cummins in the disclosure of U.S. Pat. No. 3,220,392 in 1965. In the brake system, a mechanical input is transmitted to an exhaust valve to be opened through a hydraulic circuit. The hydraulic circuit generally includes a brake piston reciprocating in a brake piston bore. The reciprocating motion comes from the mechanical input of the engine, such as the motion of the engine's fuel injection cam or the neighboring exhaust cam. The motion of the brake piston is transmitted through hydraulic fluid to a slave piston located in the hydraulic circuit, causing the slave piston to reciprocate in a slave piston bore. The slave piston acts, directly or indirectly, on the exhaust valve, thereby generating the valve event for the engine braking operation.

The engine brake device disclosed by Cummins is a bolt-on accessory that fits above the engine. In order to mount the engine brake, a spacer needs to be provided between the cylinder and the valve cover, thus the height, weight and cost of the engine are additionally increased. Obviously, the solution to the above problems is to integrate the components of the braking device into the existing components of the engine, such as into the rocker arm of the engine, thereby forming an integrated brake.

An integrated rocker-arm brake was disclosed by the Mack Truck Company of the United States in U.S. Pat. No. 3,786,792 in 1974. The brake piston of the brake system is positioned in a rocker-arm cylinder arranged at one end close to a push rod and is hydraulically locked in a protruding position, so as to transmit the motion of the cam to an exhaust valve (there is only one valve per cylinder in an early engine), thereby producing the engine braking operation. A conventional cam lobe and a braking cam lobe are integrated in the above cam. The brake control valve mechanism (a combination of a funnel-shaped plunger valve and a one-way ball valve) in the above brake system was widely used after its disclosure.

Another integrated rocker-arm brake was disclosed by the Jacobs Company (JVS) of the United States in U.S. Pat. No. 3,809,033 in 1974. The brake piston of the brake system is positioned in a rocker-arm cylinder arranged at one end close to a valve bridge and is movable between a non-braking position and a braking position. In the braking position, the brake piston is hydraulically locked in a protruding position, so as to transmit the motion of the cam to the valve bridge to open two exhaust valves (the engine has two valves per cylinder), thereby producing the engine braking operation. The braking system uses two separate oil passages, one for supplying oil to the brake, and the other being a conventional engine lubrication oil passage.

An integrated rocker-arm brake system for an overhead cam four-valve engine was disclosed by Sweden's Volvo Company in U.S. Pat. No. 5,564,385 in 1996, which is very similar in both structure and principle to the integrated rocker-arm brake disclosed by Jacobs Company (JVS) in U.S. Pat. No. 3,809,033 in 1974. The hydraulic brake piston is positioned in a rocker-arm cylinder arranged at one end close to the valve bride, and is movable between a non-braking position and a braking position and forms a gap in the engine valve system. Oil with a certain pressure is supplied to the brake piston by a pressure control valve to fill the gap in the rocker arm so as to form a hydraulic linkage. The engine braking system adopted the combined structure having a funnel-shaped plunger valve and a one-way ball valve, and added an overload pressure relief mechanism and an oil supply device for providing dual oil pressures via a single oil passage, wherein a low oil pressure (below the engine lubricating oil pressure) is used for the engine lubrication, and a high oil pressure (equal to the engine lubricating oil pressure) is used for the engine brake. During engine braking, the brake piston pushes the valve bridge to open the two exhaust valves simultaneously for braking operation.

Another integrated rocker-arm brake was disclosed by the Mack Truck Company of the United States in U.S. Pat. No. 6,234,143 in 2001, which is quite different from the technology disclosed in U.S. Pat. No. 3,786,792 in 1974. First of all, an Exhaust Gas Recirculation (EGR) cam lobe was added to the integrated cam formed with the conventional cam lobe and the braking cam lobe, which facilitates improving the braking power. Secondly, the engine with a single valve per cylinder is changed into an engine with dual valves per cylinder, and a valve bridge (an air valve bridge or a cross arm) was added. Further, the brake piston in the rocker-arm piston bore is moved from the push rod side to the valve bridge side, and is located above the exhaust valve (an inner valve) next to the rocker-arm shaft. During braking, the brake piston opens one exhaust valve via a braking-push-rod or by a direct action on the valve bridge. However, since only one valve is opened for braking, the valve bridge is in an inclined state and an asymmetric load will be generated on the valve bridge and the rocker arm. Furthermore, the braking valve (the inner valve) lift profile is greater than the non-braking valve (an outer valve) or the conventional valve lift profile (larger opening and later closing).

An integrated rocker-arm brake system having a valve lift reset mechanism was disclosed by Cummins Engine Company in U.S. Pat. No. 6,253,730 in 2001 to resolve the problems of the one-valve (the inner valve) braking, such as the asymmetric load and the braking valve (the inner valve) lift profile being greater than the non-braking valve (the outer valve) or the conventional valve lift profile (larger opening and later closing). The valve lift reset mechanism resets or retracts the brake piston in the rocker arm before the braking valve reaches its peak valve lift, which allows the braking valve to return to the valve seat before the start of the main valve action, such that the valve bridge returns to the horizontal position, and the rocker arm can open the braking valve and the non-braking valve evenly, thereby eliminating any asymmetric load.

However, there are a lot of problems with resetting the engine braking system before the braking valve reaching its peak valve lift. Firstly, during engine braking, both the opening time and the lift magnitude of the braking valve are very short, thus the time for resetting is very limited. Secondly, the resetting occurs when the engine braking load is close to the maximum (i.e. the top dead center of the compression stroke), thereby causing the reset valve of the valve lift reset mechanism to bear a high oil pressure or a large load. Thus, the engine brake resetting timing is essential. If the resetting occurs too early, the loss of braking valve lift is too much (causing a lower valve lift and the valve to be closed too early), which may reduces the braking performance. If the resetting occurs too late, the braking valve can not be closed before the start of the main valve action, which may results in an asymmetric load.

Tests show that the integrated rocker-arm brake cannot work properly at high engine speeds, because the resetting time is too short, the resetting height is too small, and the load or pressure on the reset valve is very high.

SUMMARY

An object of the present application is to provide a method for a reset rocker arm braking to solve the technical problems of the existing engine braking technologies, for example poor reliability and durability, an asymmetric braking load or unstable resetting, inconvenience in installation and adjustment, and increased height and weight of the engine.

The method for a reset rocker arm braking according to the present application includes a process of utilizing an exhaust valve actuator of an engine to open an exhaust valve, the engine including an engine brake control mechanism, the exhaust valve actuator including a cam and a rocker arm, the cam including an exhaust cam lobe and at least one brake cam lobe, the exhaust cam lobe being higher than the brake cam lobe, the rocker arm being provided with a brake oil supply passage, and the method for a reset rocker arm braking includes: arranging a brake piston bore opened downward at a lower side of one end of the rocker arm, slidably disposing a brake piston in the brake piston bore, the brake piston having an extended position and a retracted position in the brake piston bore, communicating the brake oil supply passage in the rocker arm with the brake piston bore, arranging a one-way oil supply valve between the brake piston bore and the brake oil supply passage or within the brake oil supply passage, the one-way oil supply valve having an oil supply direction from the brake oil supply passage to the brake piston bore, arranging an oil drain piston bore opened upwards at an upper side of the same end of the rocker arm, slidably disposing an oil drain piston in the oil drain piston bore, arranging an oil drain passage between the oil drain piston bore and the brake piston bore, wherein the process of utilizing the exhaust valve actuator of the engine to open the exhaust valve includes the following steps: firstly, turning on the brake control mechanism, supplying oil to the oil drain piston bore and the brake piston bore simultaneously through the brake oil supply passage, placing the brake piston at the extended position and placing the oil drain piston at a position for closing the oil drain passage; then, utilizing the brake cam lobe of the cam to drive the rocker arm and the brake piston at the extended position to open at least one exhaust valve under the brake piston; and then utilizing a rising section of the exhaust cam lobe of the cam which is higher than the brake cam lobe to keep driving the rocker arm, and at the same time, utilizing a motion of the rocker arm to change a position of the oil drain piston in the oil drain piston bore so as to open the drain oil passage to drain oil in the brake piston bore, moving the brake piston from the extended position to the retracted position, and skipping a part of the actuation onto the exhaust valve from a top portion of the exhaust cam lobe; finally, utilizing a descending section of the exhaust cam lobe of the cam to drive the rocker arm to rotate backwards, utilizing the backward motion of the rocker arm to change the position of the oil drain piston in the oil drain piston bore so as to close the oil drain passage, and at the same time, supplying oil to the brake piston bore through the brake oil supply passage and the one-way oil supply valve, re-placing the brake piston at the extended position, and starting a new engine braking cycle.

The method further includes: arranging a reset stopper mechanism at an upper side of the rocker arm at the end where the oil drain piston bore is located, and the reset stopper mechanism being fixed on the engine and configured to limit a motion of the oil drain piston in the oil drain piston bore.

The method further includes: utilizing a preload spring to maintain a gap in an exhaust valve drive chain formed by the retracted position and the extended position of the brake piston, and to eliminate any no-follow and impact within the exhaust valve drive chain.

Further, the process of utilizing the exhaust valve actuator of the engine to open the exhaust valve includes the following steps:

1) turning on the engine brake control mechanism, 2) supplying oil to the oil drain piston bore in the rocker arm through the brake oil supply passage, 3) placing the oil drain piston in the oil drain piston bore at a position for closing the oil drain passage, 4) supplying oil to the brake piston bore in the rocker arm through the brake oil supply passage and the one-way oil supply valve, 5) placing the brake piston at the extended position in the brake piston bore to form a locked hydraulic linkage, 6) driving the rocker arm and the extended brake piston by the brake cam lobe of the cam to open at least one exhaust valve, and producing a brake valve lift, 7) moving the cam into the rising section of the exhaust cam lobe which is higher than the brake cam lobe, and continuing to drive the rocker arm, the extended brake piston and the exhaust valve, 8) moving the oil drain piston in the oil drain piston bore from the position for closing the oil drain passage to a position for opening the oil drain passage so as to drain oil through the brake piston bore, 9) moving the brake piston in the brake piston bore from the extended position to the retracted position, and resetting and reducing an exhaust valve lift during an exhaust stroke of the engine, 10) descending the cam from the maximum lift of the exhaust cam lobe back to an inner base circle of the cam, and moving the rocker arm, the retracted brake piston and the exhaust valve backwards;

11) moving the oil drain piston in the oil drain piston bore from the reset position back to the braking position, and re-closing the oil drain passage; and 12) returning to step 4) and starting a new engine braking cycle.

Further, the process of utilizing the exhaust valve actuator of the engine to open the exhaust valve further includes the following steps:

1) turning off the engine brake control mechanism, 2) stopping supplying oil to the oil drain piston bore and the brake piston bore in the rocker arm, 3) opening the oil drain passage by the oil drain piston to drain oil, 4) removing a hydraulic linkage between the brake piston and the rocker arm, and forming a gap, 5) rotating the cam upwards from an inner base circle, 6) keeping the exhaust valve stationary, and 7) rotating the cam into the rising section higher than the brake cam lobe, and driving the rocker arm to open the exhaust valve, and producing a conventional exhaust valve lift.

Further, the brake cam lobe includes a compression release cam lobe.

Further, the brake cam lobe includes an exhaust gas recirculation cam lobe.

The present application also provides a reset rocker arm brake device including a brake control mechanism, a brake actuation mechanism, an exhaust valve actuator and at least one exhaust valve, wherein the exhaust valve actuator includes a cam and a rocker arm, the cam includes an exhaust cam lobe and at least one brake cam lobe, and the exhaust cam lobe is higher than the brake cam lobe, and the brake control mechanism includes a control valve connected to a hydraulic pressure generating device, the brake actuation mechanism includes an oil supply mechanism, an oil drain mechanism and a brake piston, the brake piston has an extended position and a retracted position in a brake piston bore in the rocker arm, a lower end of the brake piston is connected to at least one exhaust valve, the oil supply mechanism includes a brake oil supply passage and a one-way oil supply valve, the control valve of the brake control mechanism is connected to an inlet of the brake oil supply passage, and an outlet of the brake oil supply passage is communicated with the brake piston bore, the one-way oil supply valve is arranged between the brake oil supply passage and the brake piston bore, or within the brake oil supply passage, the one-way oil supply valve has an oil supply direction from the brake oil supply passage to the brake piston bore, the oil drain mechanism includes an oil drain valve and an oil drain passage, the oil drain valve is communicated to the brake piston bore through the oil drain passage, and the opening and closing of the oil drain valve is controlled by a distance between the rocker arm and the engine.

Further, the brake actuation mechanism further includes a preload spring configured to maintain a gap in an engine exhaust valve drive chain formed by the retracted position and the extended position of the brake piston, so as to eliminate any no-follow and impact among members of the exhaust valve drive chain.

Further, the brake actuation mechanism further includes a position-limiting mechanism configured to limit a stroke of the brake piston in the brake piston bore.

Further, the oil drain valve includes an oil drain piston disposed in an oil drain piston bore in the rocker arm, the oil drain piston has a braking position and a reset position in the oil drain piston bore, the oil drain piston bore has a bottom portion communicated with the brake oil supply passage and a middle portion communicated with one end of a drain oil passage, and the other end of the oil drain passage is communicated with the brake piston bore; at the braking position, the oil drain piston closes the oil drain passage; and at the reset position, the oil drain piston opens the oil drain passage.

Alternatively, the oil drain valve includes an oil drain piston disposed in an oil drain piston bore in a valve lash adjusting screw, the oil drain piston has a braking position and an oil drain position in the oil drain piston bore, the valve lash adjusting screw further includes an oil drain passage having one end communicated with a bottom of the oil drain piston bore and the other end communicated with the brake piston bore; at the braking position, the oil drain piston is located at the bottom of the oil drain piston bore and the oil drain passage is closed; and at the reset position, the oil drain piston is located at a top of the oil drain piston bore and the oil drain passage is opened.

Further, the brake actuation mechanism further includes a reset stopper mechanism which is fixed on the engine above one end of the rocker arm having an oil drain piston bore and configured to limit a motion of an oil drain piston in the oil drain piston bore.

The working principle of the present application is described as follows. When engine braking is required, the brake control mechanism is turned on and the control valve supplies oil to the brake actuation mechanism. Engine oil with low pressure (i.e. the engine lubrication oil) flows into the brake piston bore through the oil supply passage and the one-way oil supply valve. The brake piston is at the extended position in the brake piston bore in the rocker arm, the oil drain piston is at the braking position in the oil drain piston bore of the rocker arm, and the oil drain passage between the brake piston bore and the oil drain piston bore is closed. The brake cam lobe of the cam moves upwards from the inner base circle to drive the rocker arm and the brake piston which is at the extended position and hydraulically locked in the brake piston bore so as to open the exhaust valve for braking.

When the exhaust cam lobe of the cam moves upward to a position higher than the brake cam lobe, the oil drain piston is moved from the braking position to the reset position in the oil drain piston bore in the rocker arm, thereby opening the oil drain passage between the brake piston bore and the oil drain piston bore to drain oil out of the brake piston bore. The brake piston is moved from the extended position to the retracted position, and the exhaust valve lift is reset and reduced to the conventional exhaust valve lift profile without the engine brake.

The present application has positive and significant effects over the prior art. The present application integrates the engine braking mechanism and the reset oil drain mechanism into the existing rocker arm of the engine, thereby simplifying the design, forming a compact structure, reducing the weight and height of the engine, increasing the engine braking power, and improving reliability and durability of the engine operation.

DETAILED DESCRIPTION

First Embodiment

Figure 1:
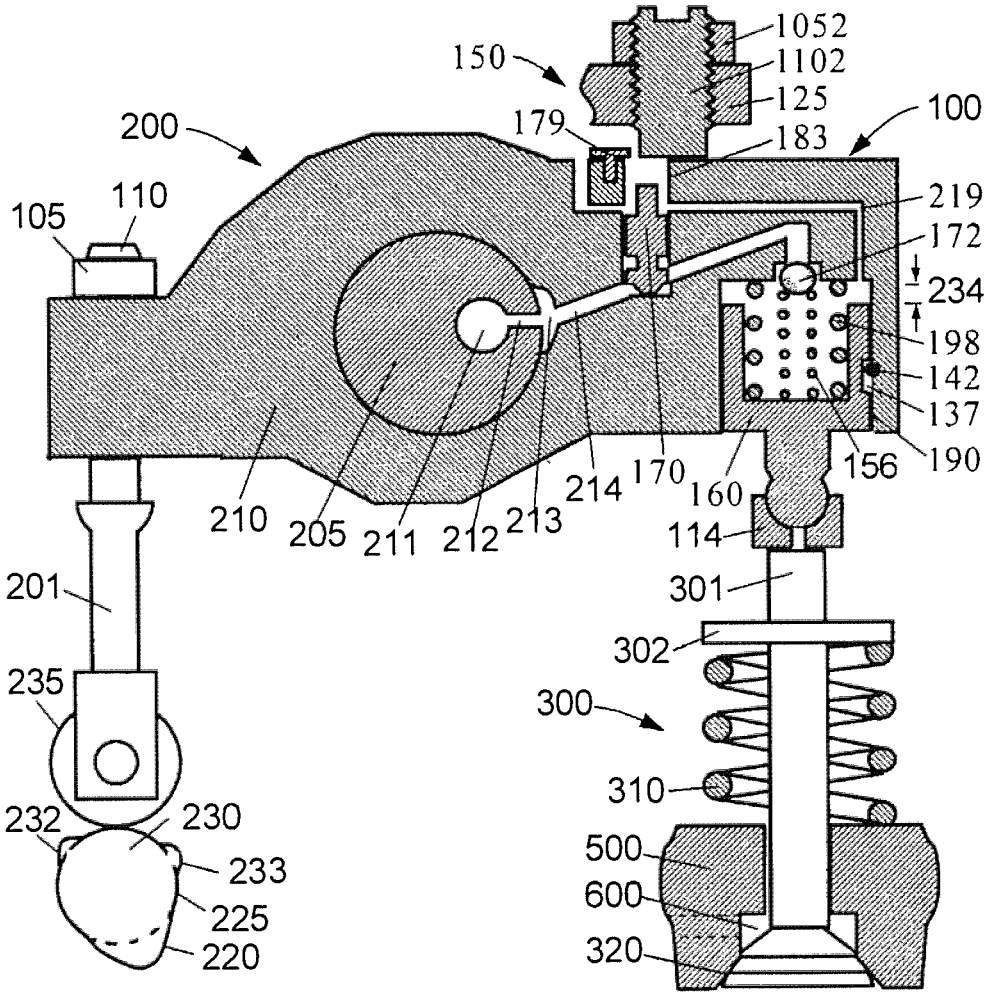
FIG. 1 is a schematic diagram showing a reset rocker arm brake device according to a first embodiment of the present application when an engine braking device is at an "OFF" position.
Figure 2:
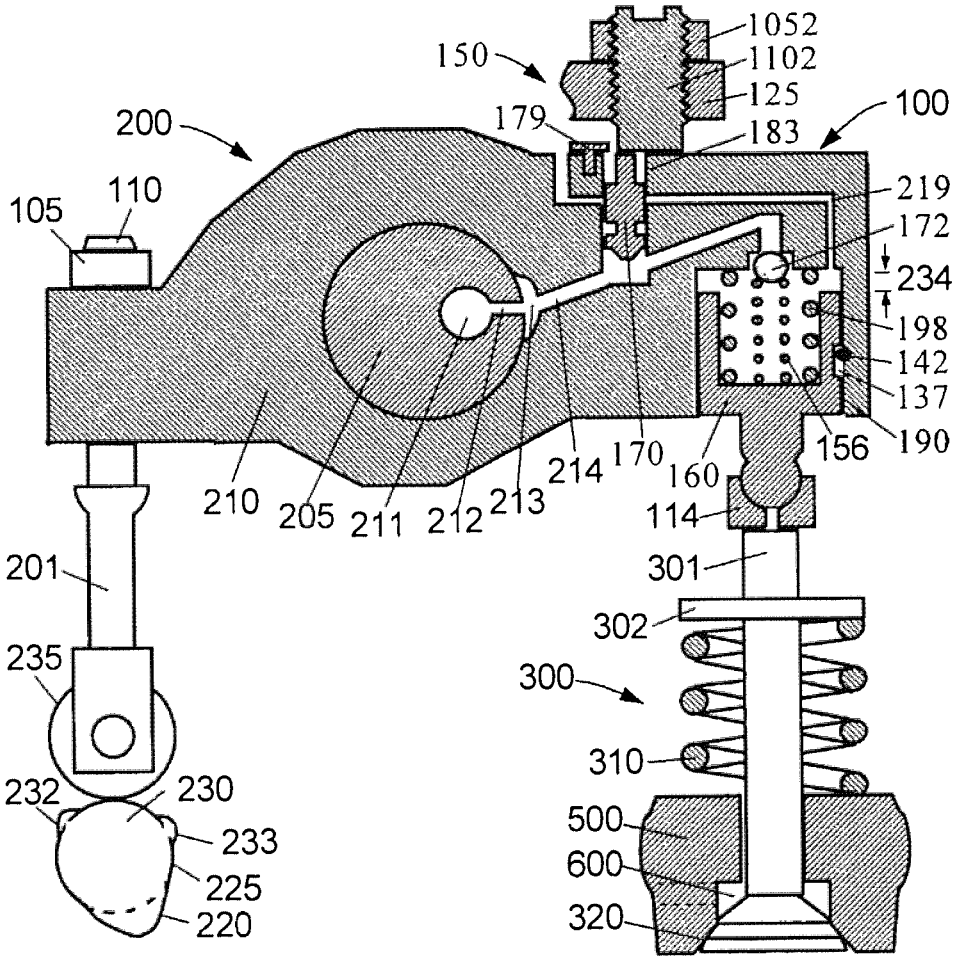
FIG. 2 is a schematic diagram showing the reset rocker arm brake device according to the first embodiment of the present application when the engine braking device is at an "ON" position.

FIGS. 1 and 2 show a reset rocker arm brake device according to a first embodiment of the present application with an engine braking device at an "OFF" position and an "ON" position respectively. There are four major parts: an exhaust valve actuator 200, an exhaust valve mechanism 300, an engine brake actuation mechanism 100 and a reset stopper mechanism 150.

The exhaust valve actuator 200 includes a cam 230, a cam follower 235, a push rod 201 and a rocker arm 210. The exhaust valve actuator 200 and the exhaust valve mechanism 300 are collectively referred to an exhaust valve drive chain. The rocker arm 210 has a valve lash adjusting system on an end near the cam 230. A valve lash adjusting screw 110 is fixed on the rocker arm 210 via a lock nut 105. The rocker arm 210 is swingably mounted on a rocker arm shaft 205.

The exhaust valve 301 is held onto a valve seat 320 in an engine block 500 via a valve spring 310 to prevent gas (air during engine braking) from flowing between an engine cylinder and an exhaust duct 600. The exhaust valve actuator 200 transmits the mechanical motion of the cam 230 to the exhaust valve 301 through the rocker arm 210, so as to periodically open and close the exhaust valve 300.

The cam 230 integrates dual functions of conventional exhaust and braking of the engine. On its inner base circle 225, the cam 230 has an enlarged cam lobe 220 mainly used for the conventional exhaust operation of the engine. The enlarged cam lobe 220, also referred to as an integrated exhaust cam lobe, is larger than a conventional exhaust cam lobe (without engine braking) because the cam 230 also has small cam lobes 232 and 233 for engine braking. A bottom of the enlarged cam lobe 220 must have a transitional portion having about the same height as the small cam lobes 232 and 233 so as to skip the braking cam lobes 232 and 233 during the engine conventional operation (i.e. an ignition operation). A top portion of the enlarged cam lobe 220 is equivalent to the conventional exhaust cam lobe. The small cam lobe 232 is used for an Exhaust Gas Recirculation (EGR) during the braking, and the small cam lobe 233 is used for compression release during the braking. Cam lift profiles generated by the enlarged cam lobe 220 and the small cam lobes 232 and 233 of the cam 230 are described in detail in FIG. 6.

The brake actuation mechanism 100 includes an oil supply mechanism, an oil drain mechanism and a brake piston 160.

The brake piston 160 is placed in a brake piston bore 190 in the rocker arm 210. The brake piston 160 has an extended position and a retracted position in the brake piston bore 190. A lower end of the brake piston 160 is connected to the exhaust valve 301 via an elephant foot pad 114. Of course, the brake piston 160 can also directly act on the exhaust valve 301. A preload spring 198 is placed between the brake piston 160 and the rocker arm 210. The preload spring 198 can be a coil spring or other forms of springs, and can be installed in different ways or at different locations, to achieve an object of maintaining a gap 234 in the exhaust valve drive chain generated by the brake piston 160 moving between the extended position and the retracted position, and eliminating any no-follow and impact between the components in the exhaust valve drive chain. The brake piston 160 is also provided with a stopping groove 137 which is combined with a stopping pin 142 in the rocker arm 210 to form a position-limiting mechanism so as to limit a stroke of the brake piston 160 in the brake piston bore 190.

The oil supply mechanism includes brake oil supply passages and a one-way oil supply valve 172. For simplicity, the engine lubrication oil passages in the rocker arm shaft 205 and in the rocker arm 210 are not shown. The brake oil-supply passages include an axial hole 211 and a radial hole 212 both arranged in the rocker arm shaft 205, a notch 213 and an oil passage 214 both arranged in the rocker arm 210. An outlet of the oil passage 214 is communicated with the brake piston bore 190. The one-way oil supply valve 172 is placed between the oil passage 214 and the brake piston bore 190, and has an oil supply direction from the oil passage 214 into the brake piston bore 190. A valve ball of the one-way oil supply valve 172 is biased on a valve seat via a spring 156. In practical application, the one-way oil supply valve 172 can be further provided with a spring seat or be mounted in different manners.

The oil drain mechanism includes an oil drain valve and an oil drain passage 219. The oil drain valve includes an oil drain piston 170 arranged in an oil drain piston bore 183 in the exhaust rocker arm 210. The oil drain piston 170 has three different positions in the oil drain piston bore 183: a non-braking position, a braking position and an oil drain position. The oil drain piston bore 183 has a bottom portion communicated with the oil passage 214, and a middle portion communicated with one end of the oil drain passage 219, and the other end of the oil drain passage 219 is communicated with the brake piston bore 190. In the non-braking position as shown in FIG. 1, the oil drain piston 170 is located at the bottom portion of the oil drain piston bore 183, and the oil drain passage 219 is open. In the braking position as shown in FIG. 2, the oil drain piston 170 is located at the middle portion of the oil drain piston bore 183, and the oil drain passage is closed. In a reset position, the oil drain piston 170 is located at a top portion of the oil drain piston bore 183, and the oil drain passage is open again. Therefore, the opening and closing of the oil drain valve is determined by the position of the oil drain piston 170 in the oil drain piston bore 183.

The reset stopper mechanism 150 is located above the rocker arm 210 at a side having the oil drain piston bore 183, and includes a stopper support 125 fixed on the engine, an adjusting screw 1102 and a lock nut 1052. The reset stopper mechanism limits the motion of the oil drain piston 170 in the oil drain piston bore 183, thereby controlling the opening and closing of the oil drain valve. That is, the opening and closing of the oil drain valve is controlled by a distance between the rocker arm 210 and the engine or between the rocker arm 210 and the reset stopper mechanism fixed on the engine. The maximum stroke of the oil drain piston 170 in the oil drain piston bore 183 is controlled by a screw 179 mounted on the rocker arm 210. The screw 179 can also be replaced by a snap ring or other positioning parts. In addition, if desired, a spring can also be arranged on the oil drain piston 170.

Figure 4:
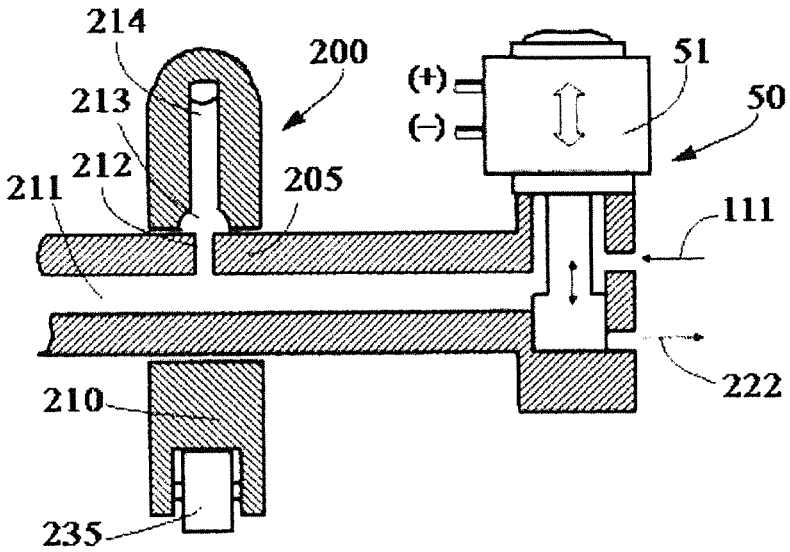
FIG. 4 is a schematic diagram showing a brake control mechanism at an "ON" position for the reset rocker arm brake device of the present application.

When engine braking is required, the brake control mechanism 50 is turned on as shown in FIG. 4. A control valve 51 of the brake control mechanism is communicated with an entrance of an axial oil passage 211 in the rocker arm shaft 205 and supplies oil to the brake actuation mechanism 100 through other brake oil supply passages. Engine oil with low pressure pushes the oil drain piston 170 from the non-braking position (as shown in FIG. 1) to the braking position (as shown in FIG. 2) in the oil drain piston bore 183. The oil drain piston 170 stops at a bottom of the adjusting screw 1102 of the reset stopper mechanism 150, thereby closing the oil drain passage 219. At the same time, engine oil is supplied to the brake piston bore 190 through the one-way oil supply valve 172. The brake piston 160 is at the extended position in the brake piston bore 190 in the rocker arm 210, thus a gap 234 is formed between the brake piston 160 and a bottom surface of the brake piston bore 190 (i.e. the rocker arm 210).

When the small brake cam lobe 233 (i.e. the compression release cam lobe) on the cam 230 rises from the inner base circle 225, the rocker arm 210 rotates clockwise, driving downward the brake piston 160 which is hydraulically locked at the extended position in the brake piston bore 190 of the rocker arm 210, and opening the exhaust valve 301 below the brake piston 160. Although there is the gap 234 between the brake piston 160 and the rocker arm 210, a hydraulically locked linkage is generated between the brake piston 160 and the rocker arm 210 by the engine oil due to the one-way oil supply valve 172 and the closed oil drain passage 219, such that the motion of the small cam lobes 233 and 232 can be transmitted to the exhaust valve 301.

In the process of rotating clockwise driven by the cam 230, the rocker arm 210 is moved away from a contact position with the reset stopper mechanism 150 as shown in FIG. 2, and the oil drain piston 170 in the oil drain piston bore 183 is also moved upwards from the braking position. However, due to the structure of the oil drain valve, the motion from the small cam lobe 233 is insufficient to open the oil drain passage 219. Thus, a top surface 147 of the oil drain piston 170 (as shown in FIG. 3) is still in contact with the adjusting screw 1102, and the oil drain passage 219 remains blocked by an outer wall of the oil drain piston 170.

In a case that the brake cam lobe of the cam 230 also includes a small cam lobe 232 for exhaust gas recirculation (EGR), the process for driving the exhaust valve 301 by the small cam lobe 232 is the same as the process for driving the exhaust valve 301 by the small cam lobe 233, which will not be described herein.

Figure 3:
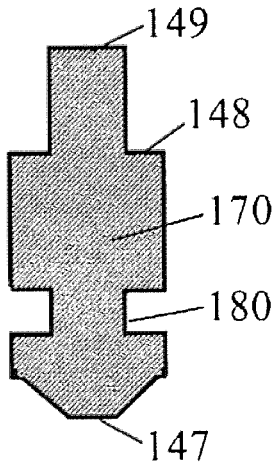
FIG. 3 is a schematic diagram showing an oil drain piston of a reset rocker arm brake device of the present application.

When the cam 230 rotates into a rising segment of the exhaust cam lobe 220 which is higher than the small cam lobe 233, the rocker arm 210 is separated from the reset stopper mechanism 150 with an enough distance, the oil drain piston 170 is moved upwards to the reset position in the oil drain piston bore 183, and an annular groove 180 on the oil drain piston 170 (as shown in FIG. 3) opens the oil drain passage 219 in FIG. 2 to drain oil out of the brake piston bore 190. The brake piston 160 is moved upwards to eliminate the gap 234, and the exhaust valve motion generated by the small cam lobe 233 is lost, and the valve lift of the exhaust valve 301 is reset to the smaller conventional exhaust valve lift profile without an engine brake.

When the cam 230 rotates into a top portion of the exhaust cam lobe 220, the top surface 147 of the oil drain piston 170 (as shown in FIG. 3) will be separated from the adjusting screw 1102, a stepped surface 148 of the oil drain piston 170 (as shown in FIG. 3) is in contact with a stopping screw 179 (as shown in FIG. 2) on the rocker arm, and the oil drain passage 219 is fully opened by the annular groove 180 on the oil drain piston 170.

When the cam 230 rotates over the highest position of the exhaust cam lobe 220 and descends back to the inner base circle 225, the rocker arm 210, the brake piston 160 retracted in the brake piston bore 190 and the exhaust valve 301 below the brake piston 160 are all moved backwards under the action of the valve spring 310. The oil drain piston 170 in the oil drain piston bore 183 is moved downwards from the reset position back to the braking position, thereby re-closing the oil drain passage 219. Engine oil is again supplied to the brake piston bore 190 through the one-way oil supply valve 172, the brake piston 160 in the brake piston bore 190 is moved from the retracted position back to the extended position, thereby starting a new cycle of engine braking.

Figure 5:
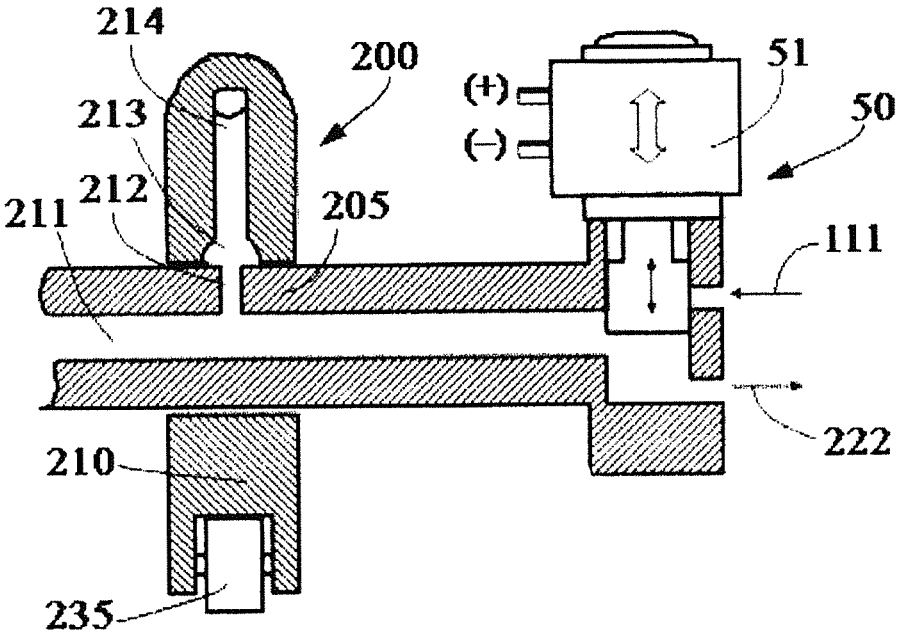
FIG. 5 is a schematic diagram showing the brake control mechanism at an "OFF" position for the reset rocker arm brake device of the present application.

When the engine brake is not required, the brake control mechanism 50 is turned off as shown in FIG. 5. The control valve 51 stops supplying oil to the brake actuation mechanism 100. Without the oil pressure, the oil drain piston 170 is at the non-braking position in the oil drain piston bore 183 as shown in FIG. 1, and the oil drain passage 219 is opened, thereby eliminating the hydraulic linkage formed between the brake piston 160 and the rocker arm 210.

When the small cam lobe 233 (i.e. the compression release cam lobe) of the cam 230 rises from the inner base circle 225, the rocker arm 210 rotates clockwise. However, due to the gap 234 between the brake piston 160 and the rocker arm 210, there is only relative motion between the rocker arm 210 and the brake piston 160, and the exhaust valve 301 remains stationary. That is, in the non-braking state as shown in FIG. 1, the motion of the small cam lobes 233 and 232 is lost due to the gap 234, and will not be transmitted to the exhaust valve 301, thereby removing the engine braking operation.

When the cam 230 rotates into the rising segment of the exhaust cam lobe 220 which is higher than the small cam lobe 233, the gap 234 between the brake piston 160 and the rocker arm 210 begins to disappear, and the rocker arm 210 will act directly on the brake piston 160 to open the exhaust valve 301. That is, in the non-braking state as shown in FIG. 1, only the motion of the top portion of the exhaust cam lobe 220 is transmitted to the exhaust valve 301 to create the conventional exhaust valve motion.

As shown in FIGS. 4 and 5, the brake control mechanism 50 for the reset rocker arm brake device of the present application is at the "ON" position and the "OFF" position respectively. The control valve 51 as shown is a two-position three-way solenoid valve. When the brake control mechanism 50 is turned on (as shown in FIG. 4), a valve body of the control valve 51 is moved downwards to open an oil supply port 111 and to close an oil drain port 222 at the same time, and engine oil with low pressure (i.e. the lubrication oil) flows to the brake actuation mechanism 100 through the brake fluid passages (as shown in FIGS. 1 and 2). When the brake control mechanism 50 is turned off (as shown in FIG. 5), the valve body of the control valve 51 is moved upwardly to close the oil supply port 111 and to open the oil drain port 222 at the same time, and engine oil with low pressure (i.e. the lubrication oil) stops flowing to the brake actuation mechanism 100 (as shown in FIGS. 1 and 2), and the brake actuation mechanism 100 drains oil through the brake fluid passages and the oil drain port 222. Since the oil drain passage 219 is arranged between the brake piston bore 190 and the oil drain piston bore 183 in the rocker arm 210 (as shown in FIGS. 1 and 2), oil may be drained once per cycle, thus a two-position two-way solenoid valve may be used to replace the three-way solenoid valve, that is, the drain port 222 is not required.

Figure 6:
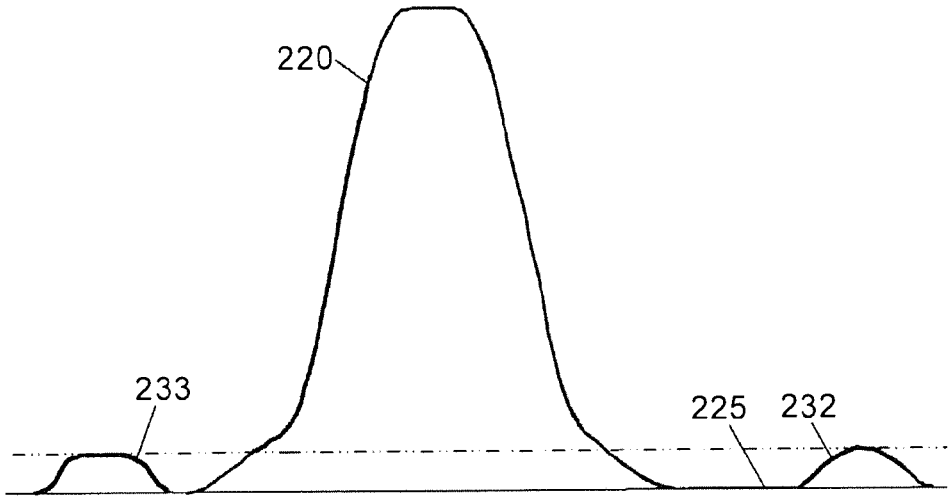
FIG. 6 is a schematic diagram showing a cam profile for the reset rocker arm brake device of the present application.

FIG. 6 shows a cam profile of the reset rocker arm brake device of the present application, which includes brake cam lobes and an integrated exhaust cam lobe 220, wherein a reference numeral 225 denotes the inner base circle of the cam. The brake cam lobes include small cam lobes 233 and 232. The integrated exhaust cam lobe 220 is divided into a top portion and a bottom portion (separated by a double dotted line as shown in FIG. 6). The bottom portion of the integrated exhaust cam lobe 220 is the transitional portion and has about the same height as the brake cam lobes. The top portion of the integrated exhaust cam lobe 220 is nearly identical to the conventional cam lobe of an engine. Thus, in a non-braking operation (for example a conventional ignition), the motion from the bottom portion of the integrated exhaust cam lobe as well as the motion from the brake cam lobes (i.e. the small cam lobes 233 and 232) are skipped or lost due to the gap 234 in the exhaust valve drive chain (as shown in FIG. 1), and will not be transmitted to the exhaust valve 301; and only the motion from the top portion of the integrated exhaust cam lobe 220 is transmitted to the exhaust valve 301, thereby generating the conventional valve lift motion.

Figure 7:
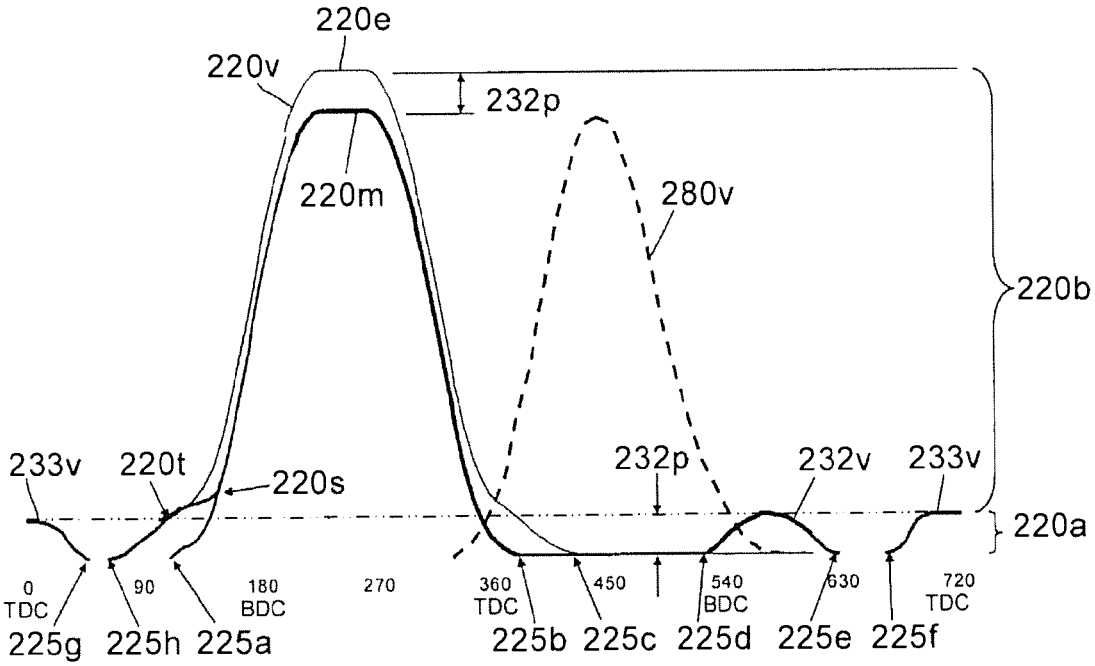
FIG. 7 is a schematic diagram showing an exhaust valve lift profile and an intake valve lift profile for the reset rocker arm brake device of the present application.

FIG. 7 shows an exhaust valve lift profile and an intake valve lift profile for the reset rocker arm brake device of the present application. An engine conventional exhaust valve lift profile 220*m* has a starting point 225*a*, an end point 225*b*, and the highest lift 220*b*. In a case that no oil drain passage 219 (the oil drain passage 219 is shown in FIGS. 1 and 2) is arranged between the brake piston bore 190 and the oil drain piston bore 183 in the rocker arm 210, an enlarged main valve lift profile 220*v* generated by the integrated exhaust cam lobe 220 during engine braking has a starting point 225*h*, an end point 225*c*, and the highest lift 220*e* which is a summation of 220*a* and 220*b*. Due to the reset effect of the oil drain valve generated through the oil drain passage 219, the valve lift profile of the exhaust valve 301 begins to transit to the main valve lift profile 220*m* at a transitional point 220*t* between the bottom portion 220*a* and the top portion 220*b* of the enlarged main valve lift profile 220V, merges into the main valve lift profile 220*m* at a point 220*s*, and closes at the end point 225*b* earlier than the case without the oil drain passage. The enlarged main valve lift profile 220*v* is reset and reduced to the conventional valve lift profile 220*m*, and the reset point 220*s* is between 220*t* and 220*m*.

During the engine braking operation, the motions of the braking cam lobes (i.e. the small cam lobes 232 and 233) are transmitted to the exhaust valve 301 under the brake piston 160 (as shown in FIG. 2) by the rocker arm 210 through a hydraulic linkage 234 and the brake piston 160, thereby producing a brake valve lift profile 232*v* for exhaust gas recirculation and a brake valve lift profile 233*v* for compression release as shown in FIG. 7. The brake valve lift profile 232*v* for exhaust gas recirculation has a starting point 225*d* located in a later stage of the intake stroke of the engine, that is, near a place when an intake valve lift profile 280*v* ends. The brake valve lift profile 232*v* for exhaust gas recirculation has an end point 225*e* located in an earlier stage of the compression stroke of the engine. The brake valve lift profile 233*v* for compression release has a starting point 225*f* located in a later stage of the compression stroke of the engine, and an end point 225*g* located in an earlier stage of the expansion stroke of the engine. The valve lift profile recycles between 0° to 720°, wherein 0° and 720° are the same point.

When the integrated exhaust cam lobe 220 of the cam 230 rises from the inner base circle 225 (as shown in FIG. 7), the rocker arm 210 pushes the exhaust valve 301 downwards through the hydraulic linkage 234 and the brake piston 160 (as shown in FIG. 2). When the cam 230 rotates into the top portion of the integrated exhaust cam lobe 220 (as shown in FIG. 7, which is greater than the maximum lift of the small cam lobe 233), the rocker arm 210 is moved further away from the reset stopper mechanism 150 as shown in FIG. 2. The oil drain piston 170 is further moved upwards in the oil drain piston bore 183 to open the oil drain passage 219, the brake piston bore 190 starts to drain oil, and the brake piston 160 is moved upwards to the retracted position in the brake piston bore 190. The valve lift profile of the exhaust valve 301 transits to the main valve lift profile 220*m* after the transitional point 220*t* (as shown in FIG. 7), and ends at the end point 225*b* which is significantly ahead of the end point 225*c* in the case without the oil drain passage. In this way, the exhaust valve lift at the top dead center in the engine exhaust stroke is reduced, which avoids the collision between the exhaust valve 301 and the engine cylinder piston, and also increases the braking power and reduces the temperature inside the cylinder.

Second Embodiment

Figure 8:
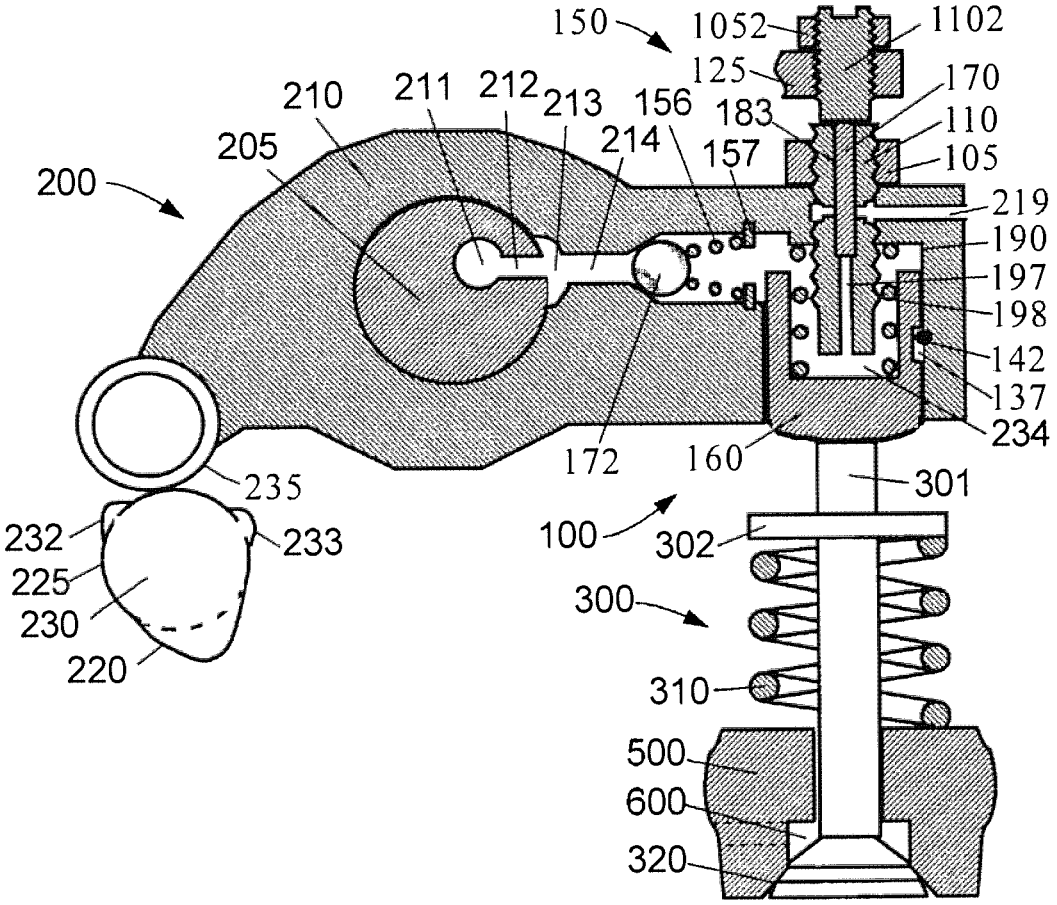
FIG. 8 is a schematic diagram showing a reset rocker arm brake device according to a second embodiment of the present application when a cam is on an inner base circle.

FIG. 8 shows the reset rocker arm brake device according to a second embodiment of the present application when the cam 230 is on the inner base circle. The present embodiment can be applied on an overhead cam engine, and there is no push rod between the cam 230 and the rocker arm 210, thus the valve lash adjusting mechanism is placed on the rocker arm 210 at an end close to the exhaust valve 301. There is no elephant foot pad under the brake piston 160, and the brake piston 160 acts directly on the exhaust valve 301. Another difference between this embodiment and the first embodiment is that the one-way oil supply valve 172 of the present embodiment is placed in the oil supply passage 214 and biased to a closed position by a spring 156. The spring 156 has one end located on the valve ball and the other end located on a spring seat 157 fixed on the rocker arm 210.

Yet another difference between this embodiment and the first embodiment is that the oil drain valve of the present embodiment is placed in the valve lash adjusting mechanism. The oil drain piston 170 is slidably disposed in the oil drain piston bore 183 in the adjusting screw 110, and an oil drain passage 197 is further arranged in the adjusting screw.

When engine braking is required, the brake control mechanism 50 is turned on as shown in FIG. 4, and the control valve 51 supplies oil to the brake actuation mechanism 100. Engine oil with low pressure flows into the brake piston bore 190 through the oil supply passage and the one-way oil supply valve 172 shown in FIG. 8. The brake piston 160 is located at the extended position in the brake piston bore 190 to form a hydraulic linkage with the rocker arm 210. When the brake cam lobe 233 (i.e. the compression release cam lobe) of the cam 230 rises from the inner base circle 225, the rocker arm 210 rotates clockwise to push down the brake piston 160 which is hydraulically locked at the extended position in the brake piston bore 190 in the rocker arm 210, thereby opening the exhaust valve 301 under the brake piston 160.

During the process of the rocker arm 210 rotating clockwise driven by the cam 230, the valve lash adjusting screw 110 on the rocker arm 210 is moved away from a contact position with the reset stopper mechanism 150 shown in FIG. 8, and the oil drain piston 170 is also moved upwards in the oil drain piston bore 183. However, due to the structural design of the oil drain valve, the motion of the small cam lobe 233 is insufficient to open the oil drain passage 219. Thus, the top surface 147 of the oil drain piston 170 is still in contact with the adjusting screw 1102, and the oil drain passage 219 is still blocked by the oil drain piston 170.

When the cam 230 rotates into the rising segment of the exhaust cam lobe 220 higher than the small cam lobe 233, the valve lash adjusting screw 110 on the rocker arm 210 is moved away from the reset stopper mechanism 150 far enough, and the oil drain piston 170 is moved upwards to the reset position in the oil drain piston bore 183 to open the oil drain passage 219, and the brake piston bore 190 drains oil through the oil drain passages 197 and 219. The brake piston 160 is moved upwards to eliminate the gap 234 between the adjusting screw 110 and the brake piston 160, such that the exhaust valve motion produced by the small cam lobe 233 is lost, and the valve lift of the exhaust valve 301 is reset and reduced to the conventional exhaust valve lift profile without the engine brake.

When the cam 230 rotates over the highest position of the exhaust cam lobe 220 and descends back to the inner base circle 225 of the cam, the rocker arm 210, the brake piston 160 retracted in the brake piston bore 190, and the exhaust valve 301 under the brake piston 160 are all moved backwards under the action of the valve spring 310. The oil drain piston 170 in the oil drain piston bore 183 is pushed back to the original position from the reset position, thereby re-closing the oil drain passage 219. Engine oil is again supplied to the brake piston bore 190 through the one-way oil supply valve 172, and the brake piston 160 is moved back to the extended position from the retracted position in the brake piston bore 190, thereby starting a new cycle of engine braking.

When the engine brake is not required, the brake control mechanism 50 is turned off as shown in FIG. 5, and the control valve 51 stops supplying oil to the brake actuation mechanism 100. Engine oil is drained out of the brake piston bore 190 through the oil drain valve and is not refilled by the oil supply mechanism, thus the hydraulic linkage is no longer formed with the rocker arm 210. The motions from the small cam lobe 233 and the brake cam lobe 232 are lost due to the gap 234, and will not be transmitted to the exhaust valve 301, thereby removing the engine braking operation. Only the motion of the top portion of the exhaust cam lobe 220 is transmitted to the exhaust valve 301 to generate the conventional exhaust valve motion.

Third Embodiment

Figure 9:
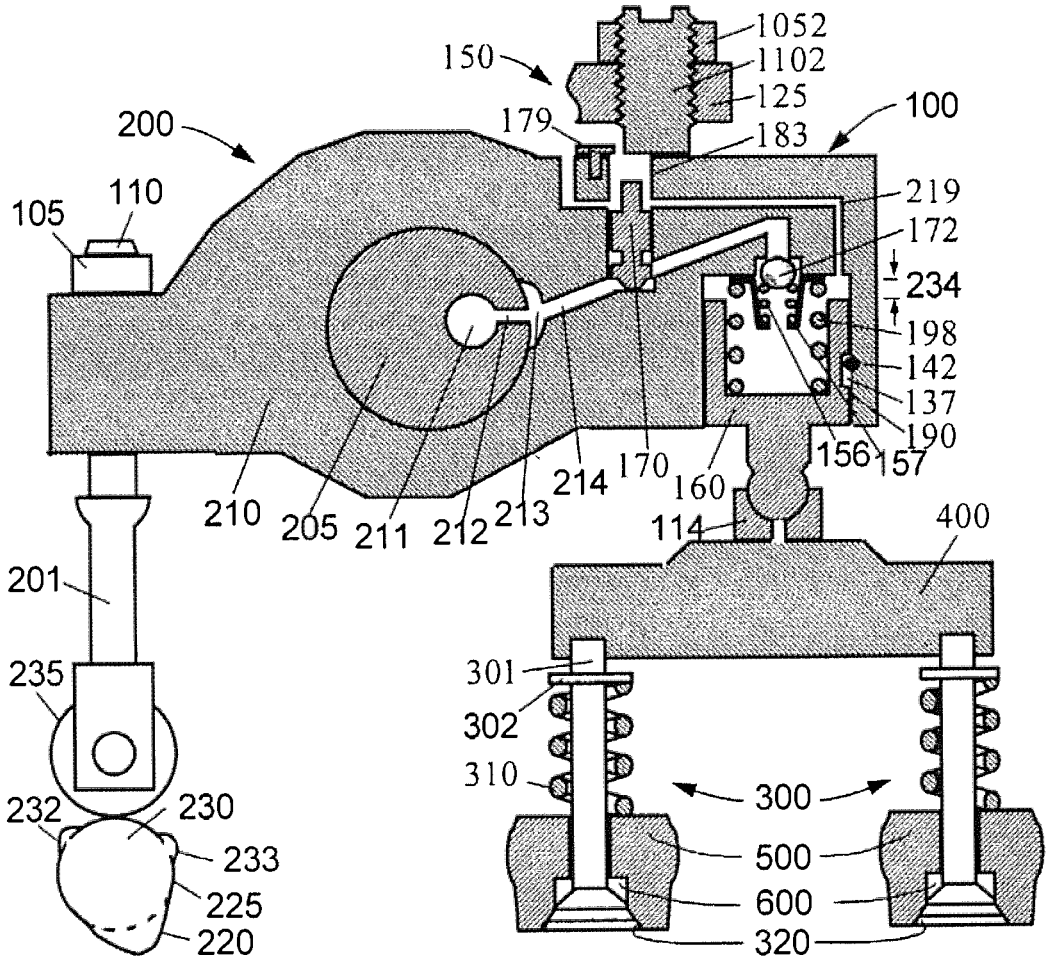
FIG. 9 is a schematic diagram showing a reset rocker arm brake device according to a third embodiment of the present application when an engine braking device is at an "OFF" position.

FIG. 9 shows the reset rocker arm brake device according to a third embodiment of the present application when the engine brake device is at an "OFF" position. A major difference between the present embodiment and the first embodiment is the engine exhaust valve mechanism 300. The exhaust valve mechanism 300 of the present embodiment includes two exhaust valves, and therefore is further arranged with a valve bridge 400 (also referred to as a valve cross arm). The elephant foot pad 114 acts on the top of the valve bridge 400 at a central position, such that the rocker arm 210 can open the two exhaust valves simultaneously through the valve bridge 400. In the present embodiment, the spring 156 for the one-way oil supply valve 172 has a spring seat 157.

Except for opening the two exhaust valves simultaneously during braking, the working principle of the present embodiment is similar to the first embodiment, thus will not be described herein.

Fourth Embodiment

Figure 10:
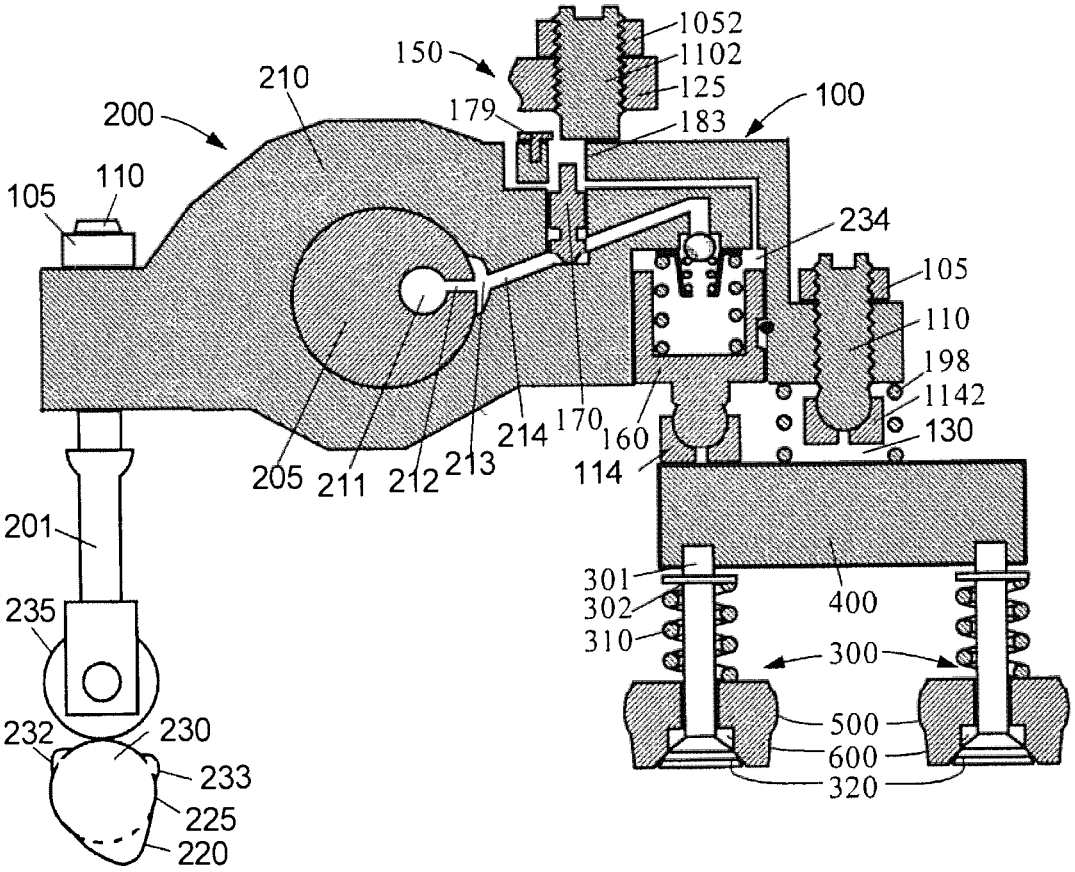
FIG. 10 is a schematic diagram showing a reset rocker arm brake device according to a fourth embodiment of the present application when an engine braking device is at an "OFF" position.

FIG. 10 shows the reset rocker arm brake device according to a fourth embodiment of the present application when the engine brake device is at an "OFF" position. A main difference between the present embodiment and the third embodiment is that, in the present embodiment only one of the two exhaust valves is opened during braking. An exhaust valve lash adjusting mechanism is further arranged on the rocker arm 210, and includes a valve lash adjusting screw 110 locked on the rocker arm 210 by a nut 105. An elephant foot pad 1142 is placed under the adjusting screw 110. A gap 130 is arranged between the elephant foot pad 1142 and the valve bridge 400, and has the same function as the gap 234, which is to skip the motions of the small cam lobes 232 and 233 during the normal operation of the engine.

The above description discloses a new reset rocker arm brake device and a method thereof. The above-described embodiments should not be regarded as limiting the scope of the present application, but rather as specific exemplifications representing the present application. Many other variations may be derived from the above embodiments. For example, the reset rocker arm brake device and the method thereof can be applied to both of an overhead cam engine and a push-rod engine, as well as a single-valve engine and a dual-valve engine. For the double-valve engine, the braking operation may be realized by opening only one valve or double valves.

Also, the one-way oil supply valve 172 may be in other forms, such as a butterfly valve. The one-way oil supply valve 172 can be placed at different locations, for example, in the brake piston 160 or in the oil supply passage. In addition, the reset stopper mechanism 150 may also in other forms. The oil drain valve may also have different structure and arrangement. Also, the brake piston 160 may be in other forms, such as an "H" form or a "T" form. The bottom of the brake piston 160 may be further arranged with a spring or be connected to an elephant foot pad 114.

In addition, the preload spring 198 may have various forms and arrangements, for example may be a coil spring, or a leaf spring, and can be placed between the rocker arm 210 and the engine, or between the rocker arm 210 and the exhaust valve 301, or between the rocker arm 210 and the valve bridge 400, or between the rocker arm 210 the push rod 201. Therefore, the scope of the present application should not be limited by the above-described specific examples, but is defined by the claims.

What is claimed is:

1. A method for a reset rocker arm braking, comprising a process of utilizing an exhaust valve actuator of an engine to open an exhaust valve, the engine comprising an engine brake control mechanism, the exhaust valve actuator comprising a cam and a rocker arm, the cam comprising an exhaust cam lobe and at least one brake cam lobe, the exhaust cam lobe being higher than the brake cam lobe, the rocker arm being provided with a brake oil supply passage, and the method for a reset rocker arm braking comprises: arranging a brake piston bore opened downward at a lower side of one end of the rocker arm, slidably disposing a brake piston in the brake piston bore, the brake piston having an extended position and a retracted position in the brake piston bore, communicating the brake oil supply passage in the rocker arm with the brake piston bore, arranging a one-way oil supply valve between the brake piston bore and the brake oil supply passage or within the brake oil supply passage, the one-way oil supply valve having an oil supply direction from the brake oil supply passage to the brake piston bore, arranging an oil drain piston bore opened upwards at an upper side of the same end of the rocker arm, slidably disposing an oil drain piston in the oil drain piston bore, arranging an oil drain passage between the oil drain piston bore and the brake piston bore, wherein the process of utilizing the exhaust valve actuator of the engine to open the exhaust valve comprises the following steps: firstly, turning on the brake control mechanism, supplying oil to the oil drain piston bore and the brake piston bore simultaneously through the brake oil supply passage, placing the oil drain piston at a position for closing the oil drain passage and placing the brake piston at the extended position; then, utilizing the brake cam lobe of the cam to drive the rocker arm and the brake piston at the extended position to open at least one exhaust valve under the brake piston; and then utilizing a rising section at a top portion of the exhaust cam lobe which is higher than the brake cam lobe to keep driving the rocker arm, and at the same time, utilizing a motion of the rocker arm to change a position of the oil drain piston in the oil drain piston bore so as to open the drain oil passage to drain oil out of the brake piston bore, moving the brake piston from the extended position to the retracted position, and skipping a part of the actuation onto the exhaust valve from the top portion of the exhaust cam lobe; finally, utilizing a descending section of the exhaust cam lobe of the cam to drive the rocker arm to rotate backwards, utilizing the backward motion of the rocker arm to change the position of the oil drain piston in the oil drain piston bore so as to close the oil drain passage, and at the same time, supplying oil to the brake piston bore through the brake oil supply passage and the one-way oil supply valve, re-placing the brake piston at the extended position, and starting a new engine braking cycle.

2. The method for a reset rocker arm braking according to claim 1, further comprising arranging a reset stopper mechanism at an upper side of the rocker arm at the end where the oil drain piston bore is located, and the reset stopper mechanism being fixed on the engine and configured to limit a motion of the oil drain piston in the oil drain piston bore.

3. The method for a reset rocker arm braking according to claim 1, further comprising utilizing a preload spring to maintain a gap in an exhaust valve drive chain formed by the retracted position and the extended position of the brake piston, and to eliminate any no-follow and impact within the exhaust valve drive chain.

4. The method for a reset rocker arm braking according to claim 1, wherein the process of utilizing the exhaust valve actuator of the engine to open the exhaust valve comprises the following steps:

1) turning on the engine brake control mechanism,
2) supplying oil to the oil drain piston bore in the rocker arm through the brake oil supply passage,
3) placing the oil drain piston in the oil drain piston bore at a position for closing the oil drain passage,
4) supplying oil to the brake piston bore in the rocker arm through the brake oil supply passage and the one-way oil supply valve,
5) placing the brake piston at the extended position in the brake piston bore to form a locked hydraulic linkage,
6) driving the rocker arm and the extended brake piston in the rocker arm by the brake cam lobe of the cam to open at least one exhaust valve, and producing a brake valve lift,
7) moving the cam into the rising section of the top portion of the exhaust cam lobe which is higher than the brake cam lobe, and continuing to drive the rocker arm, the extended brake piston and the exhaust valve,
8) moving the oil drain piston in the oil drain piston bore from the position for closing the oil drain passage to a position for opening the oil drain passage so as to drain oil through the brake piston bore,
9) moving the brake piston in the brake piston bore from the extended position to the retracted position, and resetting and reducing an exhaust valve lift during an exhaust stroke of the engine,
10) descending the cam from the maximum lift of the exhaust cam lobe back to an inner base circle of the cam, and moving the rocker arm, the retracted brake piston and the exhaust valve backwards,
11) moving the oil drain piston in the oil drain piston bore from the reset position back to the braking position, and re-closing the oil drain passage, and
12) returning to step 4) and starting a new engine braking cycle.

5. The method for a reset rocker arm braking according to claim 1, wherein the process of utilizing the exhaust valve actuator of the engine to open the exhaust valve further comprises the following steps:

1) turning off the engine brake control mechanism,
2) stopping supplying oil to the oil drain piston bore and the brake piston bore in the rocker arm,
3) opening the oil drain passage by the oil drain piston to drain oil,
4) removing a hydraulic linkage between the brake piston and the rocker arm, and forming a gap,
5) rotating the cam upwards from an inner base circle,
6) keeping the exhaust valve stationary, and
7) rotating the cam into the top portion of the exhaust cam lobe which is higher than the brake cam lobe, and driving the rocker arm to open the exhaust valve, and producing a conventional exhaust valve lift.

6. The method for a reset rocker arm braking according to claim 1, wherein the brake cam lobe comprises a compression release cam lobe.

7. The method for a reset rocker arm braking according to claim 1, wherein the brake cam lobe comprises an exhaust gas recirculation cam lobe.

8. A reset rocker arm brake device, comprising a brake control mechanism, a brake actuation mechanism, an exhaust valve actuator and at least one exhaust valve, the exhaust valve actuator comprising a cam and a rocker arm, the cam comprising an exhaust cam lobe and at least one brake cam lobe, and the exhaust cam lobe being higher than the brake cam lobe, wherein the brake control mechanism comprises a control valve connected to a hydraulic pressure generating device, the brake actuation mechanism comprises an oil supply mechanism, an oil drain mechanism and a brake piston, the brake piston has an extended position and a retracted position in a brake piston bore in the rocker arm, a lower end of the brake piston is connected to at least one exhaust valve, the oil supply mechanism comprises a brake oil supply passage and a one-way oil supply valve, the control valve of the brake control mechanism is connected to an inlet of the brake oil supply passage, and an outlet of the brake oil supply passage is communicated with the brake piston bore, the one-way oil supply valve is arranged between the brake oil supply passage and the brake piston bore, or within the brake oil supply passage, the one-way oil supply valve has an oil supply direction from the brake oil supply passage to the brake piston bore, the oil drain mechanism comprises an oil drain valve and an oil drain passage, the oil drain valve is communicated to the brake piston bore through the oil drain passage, and the opening and closing of the oil drain valve is controlled by a distance between the rocker arm and the engine.

9. The reset rocker arm brake device according to claim 8, wherein the brake actuation mechanism further comprises a preload spring configured to maintain a gap in an engine exhaust valve drive chain formed by the retracted position and the extended position of the brake piston, so as to eliminate any no-follow and impact among members of the exhaust valve drive chain.

10. The reset rocker arm brake device according to claim 8, wherein the brake actuation mechanism further comprises a position-limiting mechanism configured to limit a stroke of the brake piston in the brake piston bore.

11. The reset rocker arm brake device according to claim 8, wherein the oil drain valve comprises an oil drain piston disposed in an oil drain piston bore in the rocker arm, the oil drain piston has a braking position and a reset position in the oil drain piston bore, the oil drain piston bore has a bottom portion communicated with the brake oil supply passage and a middle portion communicated with one end of a drain oil passage, and the other end of the oil drain passage is communicated with the brake piston bore; at the braking position, the oil drain piston closes the oil drain passage; and at the reset position, the oil drain piston opens the oil drain passage.

12. The reset rocker arm brake device according to claim 8, wherein the oil drain valve comprises an oil drain piston disposed in an oil drain piston bore in a valve lash adjusting screw, the oil drain piston has a braking position and an oil drain position in the oil drain piston bore, the valve lash adjusting screw further comprises an oil drain passage having one end communicated with a bottom of the oil drain piston bore and the other end communicated with the brake piston bore; at the braking position, the oil drain piston is located at the bottom of the oil drain piston bore and the oil drain passage is closed; and at the reset position, the oil drain piston is located at a top of the oil drain piston bore and the oil drain passage is opened.

13. The reset rocker arm brake device according to claim 8, wherein the brake actuation mechanism further comprises a reset stopper mechanism which is fixed on the engine above one end of the rocker arm having an oil drain piston bore and configured to limit a motion of an oil drain piston in the oil drain piston bore.

* * * * *